United States Patent [19]

Chang

[11] 4,429,254

[45] Jan. 31, 1984

[54] DEFLECTION YOKE INTEGRATED WITHIN A CATHODE RAY TUBE

[75] Inventor: Kern K. N. Chang, Princeton, N.J.

[73] Assignee: RCA Corporation, New York, N.Y.

[21] Appl. No.: 327,632

[22] Filed: Dec. 4, 1981

[51] Int. Cl.[3] ..... H01J 23/16; H01J 29/96

[52] U.S. Cl. ..... 315/3; 313/402; 313/421; 313/431

[58] Field of Search ..... 313/158, 402, 421, 431; 315/3, 364, 400; 335/210

[56] References Cited

U.S. PATENT DOCUMENTS

| | | | |
|---|---|---|---|
| 2,143,579 | 1/1939 | Ruska . | |
| 2,143,580 | 1/1939 | Ruska . | |
| 2,206,125 | 7/1940 | Ruska . | |
| 2,698,399 | 12/1954 | Orr et al. . | |
| 3,328,627 | 6/1967 | Firmin | 315/3 |

*Primary Examiner*—David K. Moore
*Assistant Examiner*—Robert E. Wise
*Attorney, Agent, or Firm*—Paul J. Rasmussen; William H. Meise; Joseph Laks

[57] ABSTRACT

An electron beam deflection yoke is located within the glass envelope of a cathode ray tube to increase deflection sensitivity and decrease deflection power consumption. The yoke comprises a plurality of elongated core members with pole pieces formed at one end. The horizontal and vertical deflection coils are wound on the elongated core members and are energized to produce deflection fields. Deflection field return flux in the core causes fields to be formed between the pole pieces. Magnetically permeable shielding means interact with the fields produced by the coils to shield the electron beam from the deflection fields outside the region occupied by the pole pieces, resulting in a shorter deflection region which allows wider beam deflection angles.

10 Claims, 2 Drawing Figures

DEFLECTION YOKE INTEGRATED WITHIN A CATHODE RAY TUBE

This invention relates to electron beam deflection systems and in particular, to deflection systems comprising a deflection yoke located within a cathode ray tube.

BACKGROUND OF THE INVENTION

To provide deflection or scanning of electron beams produced by cathode ray tubes, in particular television kinescopes, a deflection yoke produces electromagnetic fields in the vicinity of the beams. The yoke normally comprises a set of horizontal deflection coils and a set of vertical deflection coils. The horizontal and vertical field intensities are varied by varying deflection coil current in order to deflect the beams at the line and field rate, respectively, in response to deflection signals produced by deflection circuits.

In a conventional television display system, the deflection yoke is located on the outside of the kinescope in a region encompassing a portion of the cylindrical neck and flared funnel. In order to generate sufficient deflection flux density inside the kinescope in the vicinity of the beams, the deflection coils must contain relatively large amounts of wire, resulting in a heavy and expensive device. A yoke of this type is also wasteful of energy, as the deflection fields are not localized in the vicinity of the electron beams. Significant stray or leakage flux is also produced by the yoke, which, in addition to not contributing to the desired deflection of the electron beams, also may interact with the beams in the region of the electron gun assembly. This may cause beam defocusing and, in the case of a color television receiver, misconvergence of the beams.

Placing the deflection yoke inside the glass envelope of the cathode ray tube permits a reduction in deflection power with increased deflection sensitivity since the deflection fields may be localized close to the beams. The yoke may be made quite small, resulting in significant materials and cost savings.

Locating the deflection yoke inside the tube is subject to some problems, however. The insulation of conventional enameled deflection coil wire will not withstand the high tube baking temperatures (e.g., 400° C.) encountered in the tube manufacturing process. These temperatures cause the enameling to be burned, resulting in the occurrence of short circuits in conventionally-wound deflection coils. The burned insulation also contaminates the tube internal environment. Also, the yoke, at approximately ground potential, may be located close to portions of the electron gun assembly which are at high potentials (e.g., 25 kv.). Arcing between internal tube components may occur.

As previously described, maximum deflection sensitivity and minimum deflection power consumption is achieved by placing the deflection coils as close as possible to the electron beams. The deflection coils, however, must have enough ampere-turns to develop sufficient flux density to properly deflect the beams. This requirement may result in an elongated yoke which has a relatively long deflection region. Since the deflection coils are close to the beams, beam deflection through the deflection region must be gradual to prevent the deflected beams from striking portions of the yoke. This results in narrow beam deflection angles, which is undesirable in television kinescopes, since it requires longer tubes. Television kinescopes preferably have large deflection angles (e.g., 90°–110°) resulting in smaller, more compact receivers.

SUMMARY OF THE INVENTION

In accordance with the present invention, a deflection yoke within the glass envelope of a cathode ray tube deflects an electron beam produced by the cathode ray tube. The deflection yoke includes a number of magnetically permeable elongated core pieces which incorporate flux directors arranged near the electron beam. Electron beam deflection coils are wound on the elongated core pieces and can be energized to produce electromagnetic fields in the vicinity of the coils and in the vicinity of the flux directors in order to deflect the electron beam. Shields interact with the electromagnetic fields in order to shield the electron beam from the electromagnetic fields outside the region occupied by the flux directors.

BRIEF DESCRIPTION OF THE DRAWING

In the accompanying drawing.

DETAILED DESCRIPTION

Figure 1:
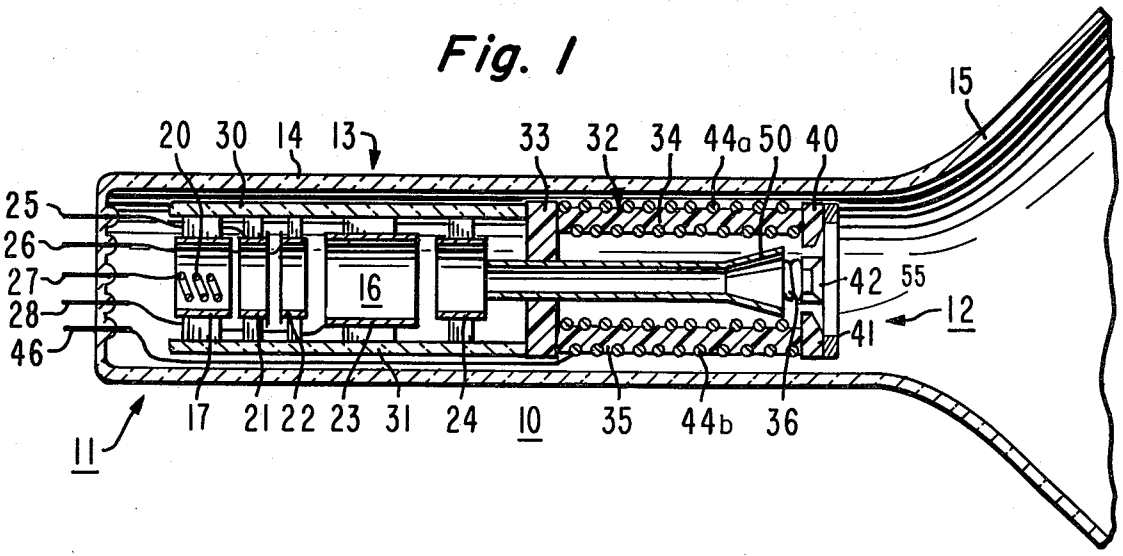
FIG. 1 is a top plan cross-sectional view of a television display system incorporating a deflection yoke constructed in accordance with the present invention.

Referring to FIG. 1, there is shown a television display system 10 comprising a kinescope 11 and a deflection yoke 12. The kinescope 11 includes a sealed glass envelope 13 having an elongated cylindrical neck portion 14 joined to a flared funnel portion 15. The funnel portion 15 is also joined to a front panel (not shown) which includes a display screen (also not shown).

An electron gun assembly 16 is disposed within the neck portion 14 of glass envelope 13. The electron gun assembly 16 comprises a cathode 17, including a heater coil 20, and a number of electrodes or grids 21, 22, 23, 24 which form, focus and accelerate an electron beam from the electrons produced by cathode 17. Electrodes 21, 22, 23 and 24 have apertures formed in them to permit passage of the electron beam(s). The function of each electrode is determined in part by its design and in part by the potential or voltage applied to it. The appropriate voltages are provided by television receiver circuits (not shown) and are applied to the kinescope 11 via terminal pins 25, 26, 27 and 28, for example. In the FIGURE, terminal pin 25 is shown connected to electrode 21, terminal pin 26 is connected to electrode 22, terminal pin 27 is connected to heater coil 20 and terminal pin 28 is connected to electrode 23. The previously described elements of electron gun assembly 16 are held in place by their attachement to elongated glass beads or rods 30 and 31, which insulate the elements of gun assembly 16 from each other. The construction and operation of electron gun assembly 16 is conventional and will not be described in detail. Electron gun assembly 16 is shown as producing a single electron beam. It is to be understood that an electron gun assembly producing three electron beams for use in a color television kinescope is also contemplated to be within the scope of the present invention.

In accordance with the present invention, deflection yoke 12 is disposed within the interior of glass envelope 13 of kinescope 11. Deflection yoke 12 is illustratively shown as being disposed within the neck portion 14 of envelope 13, but it is also to be understood that it may be located at some other position within envelope 13.

Figure 2:
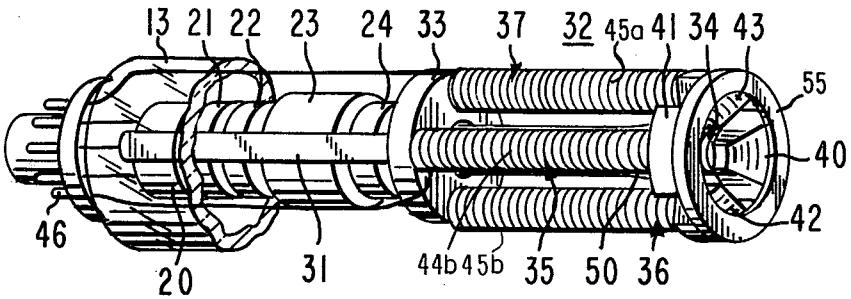
FIG. 2 is a perspective view of a portion of the display system shown in FIG. 1 with parts broken away for clarity.

Deflection yoke 12 comprises a magnetically permeable core structure 32 illustratively shown as including a ring-shaped base 33 and four elongated rod-shaped members 34, 35, 36 and 37 (shown in FIG. 2). Elongated members 34, 35, 36 and 37 extend parallel to the longitudinal axis of envelope 13 and may be formed as a part of base 33 or they may be manufactured individually and mounted to base 33. Base 33 is illustratively shown as mounted to glass beads 30 and 31 in order to secure yoke 12 within glass envelope 13. The ends of elongated members 34, 35, 36 and 37 remote from base 33 each form a flux directing member or pole piece 40, 41, 42 and 43 respectively, which are supported in a conventional manner by solid ring 55, manufactured of stainless steel or a similar nonmagnetic material. The flux directing members are angled perpendicular to the longitudinal axis of orientation of elongated members 34, 35, 36 and 37.

Vertical deflection coils 44*a* and 44*b* are wound about elongated members 34 and 35, and horizontal deflection coils 45*a* and 45*b* are wound about elongated members 36 and 37 (as shown in FIG. 2). The deflection coils are energized by circuits in the television receiver via the appropriate kinescope terminal pins. In FIG. 1, vertical deflection coils 44 are illustratively shown as connected to terminal pin 46. The current paths in the four coils 44*a*, 44*b*, 45*a* and 45*b* are completed in a conventional manner through other terminal pins, not shown. As previously stated, the tube manufacturing environment is unsuitable for conventional enameled wire. To prevent short circuiting of the coils or contamination of the tube, bare uninsulated wire may be used for deflection coils 44 and 45. In order to keep successive wire turns of the coils from touching each other (and hence causing a short circuit through the coil), elongated members 34, 35, 36 and 37 are grooved to accommodate the wire of coils 44 and 45, as can be seen in FIG. 1. The spacing of the grooves in elongated members 34, 35, 36 and 37 is chosen to provide correct spacing of the coil wire turns.

In order to develop sufficient deflection field flux density to properly deflect the electron beam, the number of ampere-turns of wire for each of the horizontal and vertical coils must exceed a certain minimum. Using the arrangement shown in FIG. 1, this ampere-turn requirement causes the coils to be relatively long, resulting in a long beam deflection region. Even relatively weak deflection fields applied to the beams over a long beam deflection region may cause beam deflection to begin too near the electron gun assembly and may cause beams so deflected to strike portions of the yoke 12 or glass envelope 13. Reducing the deflection field strength to allow the beam to deflect slowly through the entire deflection region will result in an overall beam deflection angle to the display screen that is small. Small deflection angles are undesirable for television kinescopes, as this results in a tube with a long overall length which requires larger or bulkier cabinetry. The deflection yoke of the present invention shown in FIG. 1 provides rapid beam deflection through a short deflection region resulting in a large deflection angle suitable for wide-angle television kinescopes.

As previously described, each of the elongated members 34, 35, 36 and 37 includes a pole piece or flux directing member. These pole pieces are located at the end of the elongated members and are free of wire turns. Deflection coils 44 and 45 produces flux through core structure 32 and through the pole pieces and also through the region between the pole pieces. This flux forms a field between opposite facing pole pieces in the vicinity of the end of yoke 12. The shape of the pole pieces is chosen to yield the shape and distribution of the resultant fields. As described, the pole pieces are angled perpendicular to the longitudinal axis of the elongated members. The pole pieces extend inwardly from ring 55 and become progressively smaller in cross-sectional area. The pole pieces produce, by conventional field forming techniques, the vertically oriented horizontal deflection field between pole pieces 42 and 43, and the horizontally oriented vertical deflection field between pole pieces 40 and 41. The actual size and shape of the pole pieces required to form the desired deflection fields is a function of well known factors, such as high voltage level, core material, and number of deflection coil wire turns. This field may then be used to provide the desired electron beam deflection. To prevent premature deflection through the length of the yoke, a magnetically permeable tubular member 50 is placed coaxial with the electron beam path to shield the electron beam from the deflection fields produced along the length of the yoke. The magnetically permeable nature of tubular member 50 provides a lower reluctance path for the field flux than air, so that substantially no field will reach the beam while the beam is within tubular member 50. Tubular member 50 terminates near the end of yoke 12 and does not extend into the region between pole pieces 40, 41, 42 and 43, so that substantially all of the deflection of the electron beam will occur within the region occupied by pole pieces 40, 41, 42 and 43. Tubular member 50 is illustratively shown as mounted to electrode 24 of electron gun assembly 16. Electrode 24 may be at a very high potential, of the order of 20 kv. Since the yoke operates at substantially ground potential, it is important to provide adequate insulation between tubular member 50 and the other parts of yoke 12 to prevent arcing from occurring. Insulating materials may be used, but is has been found that the vacuum inside envelope 13 is sufficient to substantially prevent arcing under normal conditions.

A particular embodiment of a deflection yoke in accordance with the present invention used a core made of maganese zinc ferrite, with the elongated rods being 0.25 inches (6.35 mm.) in diameter and 1.25 inches (31.75 mm.) long. The coils were wound with a pitch of 32 turns per inch, and the horizontal and vertical coils each had an inductance of 0.26 mh.

What is claimed is:

1. A deflection yoke disposed within the glass envelope of a cathode ray tube for deflecting an electron beam produced by said cathode ray tube, comprising:

a plurality of magnetically permeable elongated members incorporating flux directing means disposed in the vicinity of said electron beam;

electron beam deflction coils wound on said elongated members adapted to be energized for producing electromagnetic fields in the vicinity of said coils and in the vicinity of said flux directing means for deflecting said electron beam; and shielding means interacting with said electromagnetic fields for shielding said electron beam from said electromagnetic fields outside the region occupied by said flux directing means.

2. The arrangement as defined in claim 1, wherein said shielding means comprises a magnetically permeable member extending substantially parallel to and substantially centered between said elongated members.

3. A display system comprising a cathode ray tube incorporating a glass envelope and a deflection yoke disposed within said glass envelope for deflecting an electron beam produced by said cathode ray tube, said deflection yoke comprising:

a plurality of magnetically permeable elongated members incorporating flux directing means disposed in the vicinity of said electron beam;

electron beam deflection coils wound on said elongated members adapted to be energized for producing electromagnetic fields in the vicinity of said coils and in the vicinity of said flux directing means for deflecting said electron beam; and shielding means interacting with said electromagnetic fields for shielding said electron beam from said electromagnetic fields outside the region occupied by said flux directing means.

4. The arrangement defined in claim 3, wherein said shielding means is constructed of a magnetically permeable material.

5. The arrangement defined in claim 3, wherein the number of said plurality of elongated members is four.

6. The arrangement defined in claim 3, wherein said electron beam deflection coils comprise uninsulated wire.

7. The arrangement defined in claim 3, wherein said elongated members are grooved to provide a predetermined path for said electron beam deflection coils.

8. The arrangement defined in claim 3, wherein said deflection yoke is disposed adjacent to an electron gun assembly of said cathode ray tube.

9. The arrangement as defined in claim 3, wherein said shielding means comprises a magnetically permeable member extending substantially parallel to and substantially centered between said elongated members.

10. A display system incorporating a cathode ray tube comprising:

a glass envelope;

an electron gun assembly disposed within said glass envelope for producing an electron beam;

a deflection yoke disposed within said glass envelope for deflecting said electron beam, comprising:

a core structure comprising a plurality of magnetically permeable elongated members incorporating flux directing means formed at the end of said elongated members remote from said electron gun assembly, said elongated members having grooves to provide a predetermined wire path;

electron beam horizontal and vertical deflection coils wound on said elongated members within said grooves, said deflection coils adapted for being energized to produce first electromagnetic fields between said elongated members, whereby return flux from said first electromagnetic fields in said elongated members causes second electromagnetic fields to be formed between said flux directing means; and magnetically permeable shield means interacting with said first electromagnetic fields to substantially shield said electron beam from said first electromagnetic fields, whereby deflection of said electron beam is substantially provided only by said second electromagnetic fields.

* * * * *